US005930332A

United States Patent [19]

Eggleston et al.

[11] Patent Number: 5,930,332

[45] Date of Patent: Jul. 27, 1999

[54] METHOD FOR CONNECTING A MOLYBDENUM-BASED ALLOY STRUCTURE TO A STRUCTURE FORMED FROM A MORE DUCTILE ALLOY, AND RELATED ARTICLES

[75] Inventors: Michael Robert Eggleston, Scotia; Mark Gilbert Benz, Burnt Hills; Herman Arthur Nied, Ballston Lake, all of N.Y.

[73] Assignee: General Electric Company, Schenectady, N.Y.

[21] Appl. No.: 08/758,327

[22] Filed: Dec. 3, 1996

[51] Int. Cl.[6] ..... H01J 35/10

[52] U.S. Cl. ..... 378/144; 445/28; 228/113; 228/262.7

[58] Field of Search ..... 445/28, 35; 228/107, 228/108, 113, 262.7, 175; 378/125, 143, 144

[56] References Cited

U.S. PATENT DOCUMENTS 4,119,261 10/1978 Devine, Jr. ..... 228/113
4,129,241 12/1978 Devine, Jr. .
4,224,273 9/1980 Magendans et al. ..... 445/35
4,574,388 3/1986 Port et al. .
4,670,895 6/1987 Penato et al. .
4,747,350 5/1988 Szecket ..... 228/108
5,498,186 3/1996 Benz et al. .

*Primary Examiner*—Kenneth J. Ramsey
*Attorney, Agent, or Firm*—Ernest G. Cusick; Noreen C. Johnson

[57] ABSTRACT

A new method for forming a joint between a molybdenum-based alloy structure and a structure formed from a more ductile alloy is disclosed. The method involves the solid-state bonding of the two structures, which can be carried out by a variety of techniques, such as inertia-welding or explosive-welding. The molybdenum-based alloy may be a TZM-type material, while the more ductile alloy may be tantalum-based, niobium-based, or nickel-based, for example. This method is especially useful in the manufacture of x-ray devices, such as those which include rotary anode assemblies. As one illustration, the method can be used to provide a very strong joint between a target formed from a molybdenum alloy and an insert formed from a tantalum alloy. Related x-ray assemblies are also described.

28 Claims, 4 Drawing Sheets

METHOD FOR CONNECTING A MOLYBDENUM-BASED ALLOY STRUCTURE TO A STRUCTURE FORMED FROM A MORE DUCTILE ALLOY, AND RELATED ARTICLES

TECHNICAL FIELD

This invention relates generally to metallurgical processes. More particularly, it relates to techniques for joining structures made from dissimilar metal alloys, e.g., those which are part of x-ray equipment.

BACKGROUND OF THE INVENTION

High performance metal alloys are critical materials for a wide variety of equipment manufactured today. As an example, many molybdenum alloys possess a great deal of high temperature strength. Other types of refractory metal alloys also exhibit desirable combinations of high strength and low thermal conductivity.

X-ray equipment is a good example of the usefulness of high performance alloys. Many components within these devices are made from such materials. Often, the x-ray target and some of the related components are made from molybdenum alloys like titanium-zirconium-molybdenum (TZM). Other components within the device may be made from niobium or tantalum alloys. The utility of these materials is based in large part on their ability to function well in the high temperature environment created during the operation of an x-ray unit.

Obviously, the welds or joints between various metallic structures in a device like an x-ray machine have to be reliable and durable. However, some of the characteristics of high performance alloys can present challenges in obtaining high quality, stable joints. For example, the surface of TZM has the tendency to oxidize to some extent. This oxide, which is difficult to remove, can make bonding to other alloys quite difficult.

Moreover, TZM exhibits limited ductility at room temperature. In assembling the many components of an x-ray device, parts made of TZM will be joined to parts made from more ductile alloys. For example, x-ray tubes which are used in radiology often employ a rotary anode. The "target" is the portion of the anode where the electron beam makes contact, and the x-rays are generated. It is usually shaped like a disk, and is fixed to a support shaft, which is itself connected to a rotor. The anode target is usually made of TZM. It is sometimes joined to an insert made from a ductile, tantalum-based alloy, as disclosed, for example, in U.S. Pat. No. 5,498,186 (M. Benz et al.).

This bonding between metals of varying ductility can prove troublesome during the assembly and operation of an x-ray device. Rotary targets are often exposed to very strong thermal shocks, and they can reach very high temperatures. Failure of x-ray devices in the field has often been traced to connections in this section of the device. In some instances, mechanical stress can loosen the rotary target, and the entire anode assembly can then become unbalanced. Unacceptable vibration and/or mechanical breakage of the assembly may then occur. The need for a balanced target/stem assembly is also critical during the manufacturing cycle, especially in the case of the larger x-ray targets being made today. The frequent occurrence of unbalanced assemblies leads to reduced manufacturing yields.

It should thus be apparent that there is a continuing need for improvements in joining structures made from different metal alloys. More specifically, there would be considerable benefit in new techniques for connecting structures formed from alloys which have different ductility levels, e.g., molybdenum-based alloys joined to structures made from more ductile alloys like those based on tantalum. These techniques should be especially suitable for connecting various x-ray components—especially those used in rotary anode-type x-ray units. Furthermore, these new processes should be compatible with existing fabrication techniques currently being used to manufacture x-ray equipment.

SUMMARY OF THE INVENTION

The needs described above have been satisfied by the discovery of a new method for forming a joint between a molybdenum-based alloy structure and a structure formed from a more ductile alloy. The method comprises the solid-state bonding of the two structures over a bonding period of less than about 1 minute. The bonding can be carried out by a variety of techniques, such as inertia-welding, explosive welding, or upset-welding. Often, the molybdenum-based alloy (or "molybdenum alloy", for brevity) comprises titanium, zirconium, and molybdenum (e.g., TZM), while the more ductile alloy could be a tantalum-based material, a niobium-based material, or a nickel-based material. This method is especially useful in the manufacture of x-ray devices, such as those which include rotary anode assemblies.

Thus, another embodiment of this invention is directed to an improved method for bonding an x-ray target to a tubular stem for use in a rotating x-ray tube, comprising the steps of:

(I) solid-state bonding an insert to the target;

(II) attaching the tubular stem to the combined target/insert to form a stem/target assembly; and (III) connecting the stem/target assembly formed in step (II) to a rotor body assembly.

Further details regarding this invention are found in the remainder of the specification.

DETAILED DESCRIPTION OF THE INVENTION

Figure 1:
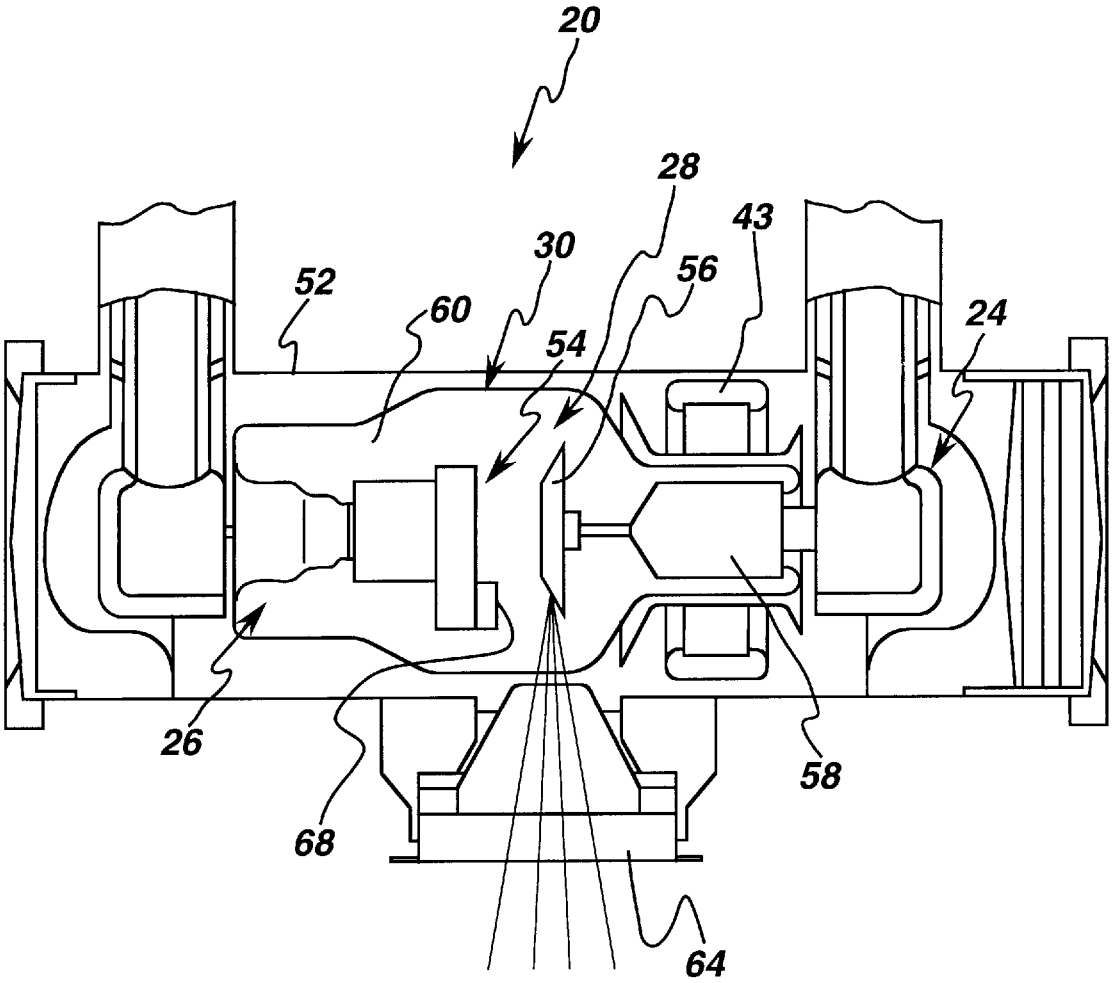
FIG. 1 is a schematic representation of a typical x-ray system, having an x-ray tube positioned therein.

As mentioned above, solid-state bonding is used in the present invention to form a joint between a molybdenum-based alloy structure and a structure formed from a more ductile alloy. The "more ductile" alloy could be tantalum-based, niobium-based, or nickel-based, for example, and will be discussed below. Materials falling into this classification (relative to the molybdenum-based alloy) are those which can be successfully fusion-welded without cracking. Moreover, materials of this type can usually be bolted tightly to parts formed from the molybdenum alloy without the occurrence of a substantial number of localized cracks at the bolting site. Another parameter which is useful for classifying ductility in this discussion is room-temperature ductility. In other words, molybdenum alloys like TZM usually have a room-temperature ductility of less than about 5% (as measured in a standard, room-temperature tensile test). In contrast, niobium-based alloys often have a room-temperature ductility above about 20%.

The term "solid-state bonding" is used herein to embrace a number of bonding techniques in which two metal surfaces are brought into intimate contact in a manner which permits a cohesive force between the atoms of the two surfaces to hold them or weld them together without substantially heating materials at a weld interface to the melting point. The term is described, for example, in *Welding and Welding Technology,* by R. L. Little, McGraw-Hill, Inc., 1973.

As used herein, "solid-state bonding" is defined to exclude diffusion-bonding techniques, which are outside the scope of this invention. The bonding period for joining structures according to this invention is defined as the period during which the structures are in contact with each other at the appropriate bonding temperature. This period is less than about 1 minute, and in embodiments, is less than about 30 seconds. In some especially embodiments, the period is less than about 10 seconds. These periods are much shorter than the joining times for diffusion bonding techniques, as discussed below. At least three specific techniques are included within the scope of solid-state bonding: friction welding, upset welding, and explosive welding.

Friction welding involves the fusion of two metals or metal alloys by the creation of resistance between the surfaces to be joined. The technique is described in the Little text mentioned above, as well as in *Welding and Other Joining Processes,* by R. Lindberg et al, Allyn and Bacon, Inc., 1976; and in *Smithells Metals Reference Book,* Seventh Edition, Butterworth-Heinemann, 1992. Usually, the parts to be friction welded are axially aligned so that one part can be rotated against a stationary part. The frictional heat is controlled by the speed of rotation and the axial pressure of the non-rotating piece. As the temperature at the interface of the two pieces increases, the pieces approach the appropriate welding temperature. At that point, the forging phase takes place: rotation is stopped (or in some variations, the rotating piece is allowed to spin until the mechanical energy is dissipated), and the pressure is increased until the weld is completed. Welding time usually lasts between about 1 to about 10 seconds, depending on the materials being welded and the joint design.

As an illustration, a 0.625 inch diameter rod of a molybdenum-based alloy could be adequately joined to a tantalum-based alloy of similar size and shape at a contact pressure in the range of about 4000 psi to about 6400 psi, while the molybdenum alloy is rotated at about 5000 rpm to about 7000 rpm. The flywheel rotational inertia is usually in the range of about 3 to about 6 lbs-ft$^2$. (Sometimes, the molybdenum-based component is pre-heated at a temperature in the range of about room temperature to about 800° C .). Those of skill in this field of welding understand that some versions of the technique involve lower rotational speeds with high axial force, while other versions call for higher rotational speeds with a lower axial force. The most appropriate speed and axial force will depend in large part on the particular alloys being welded.

In order to ensure a quality weld, the machinery required for friction welding should be capable of very accurately controlling three variables: axial pressure, rotational speed, and flywheel rotational inertia. Appropriate machinery meeting these requirements is commercially available. Usually, the parts being welded can be of almost any shape, as long as they share a common axis. Only one of the parts rotates about an axis of symmetry. The maximum size of the parts is obviously determined by the size of the welding machine. Various forms of friction welding are practiced on an industrial level, such as continuous rotation welding.

As mentioned above, one specific type of friction welding is known in the art as inertia-welding, which is very useful for rapidly joining dissimilar metals and/or metal alloys without interfacial melting (which would alter the microstructure). Inertia-welding is usually the preferred bonding technique for various embodiments of the present invention. It is described in a variety of references, such as the Lindberg text mentioned above, and in U.S. Pat. Nos. 4,757,932; 4,129,241; and 3,882,593, all incorporated herein by reference. Those skilled in the art understand that inertia-welding involves the selection of various parameters, such as the polar moment-of-inertia; the angular velocity of the flywheel; and the hydrostatic pressure in the ram for the axial load. Typically, a flywheel is first attached to one of the components being joined. The flywheel is then brought up to a predetermined angular velocity which is precisely regulated by the use of an electric motor storing the kinetic rotational energy. When the appropriate level of kinetic energy is reached, the flywheel is disengaged from the drive motor by a clutch. The other component being joined (i.e., the non-rotating component) is quickly brought into contact with the rotating component under a constant, large axial load. The mechanical energy-of-rotation is converted to heat at the joining interface by friction. As the mechanical energy-of-rotation is being dissipated, the heat being generated raises the temperature at the interface. Since the axial load being applied is very large, deformation ("axial upset") occurs locally at the interface where the temperature-rise has been greatest. The metal thus plastically deforms under the axial load, and metal material which was originally at the interface is swept radially-outward, forming the "flash". The flywheel usually comes to rest in a matter of seconds. Typically, the axial load is maintained until the weld is cooled.

Those of skill in the art understand that there could be quite a few variations in the exemplified steps, but the technique is still considered to be inertia-welding. One significant advantage in using inertia-welding is that it promotes the break-up of surface contaminants and oxides, in effect "flushing" them into the flash. This in turn allows nascent material from each component to be brought into contact.

Thus, some of the primary steps in a typical process for inertia welding the molybdenum alloy structure to a more ductile alloy according to the present invention are as follows:

a) placing the structures to be joined together in an inertia-welding apparatus, whereby the respective, joining surface areas of the structures are spaced from each other and positioned to contact each other at a bonding interface; and b) rotating one of the structures at a predetermined rotational speed and a corresponding mechanical energy value while the other structure remains fixed in a non-rotating position, wherein the predetermined rotational speed is high enough to provide sufficient energy for bonding when the rotating structure comes into contact with the fixed structure; and c) bringing the two structures into contact with each other, hereby the heat generated as the mechanical energy of the rotating structure is dissipated is sufficient to plastically deform the metal at the bonding interface, causing a joint to be formed between the two structures.

As mentioned above, the weld is then allowed to cool, and a strong, very reliable joint is thus formed between the two structures. Those of skill in the art understand that the parameters for inertia welding will of course be adjusted according to the types of materials being joined. The most appropriate parameters can be determined without undue effort, based in part on the teachings herein.

A bonding technique for x-ray components will be provided as a specific example for one embodiment of the present invention. In this illustration, an x-ray target with an outer diameter of about 4 to about 8 inches is to be bonded to a rotatable target insert (as described below in the figure). The insert has an outer diameter of about 1 inch to about 2 inches. The thickness of the central portion of the target is about 0.4 inch to about 0.75 inch, and the angle (or taper) between the two components is set at about 25 degrees to about 45 degrees with respect to the rotational axis of the target. Under these conditions, using a standard inertia-welding apparatus, the required contact stress perpendicular to the weld joint will usually be in the range of about 4500 psi to about 10,000 psi. Typically, this pressure is translated into hydraulic pressure or "ram pressure" values which are set on the inertia-welding apparatus. The speed of the rotating component (usually the insert, with the target being fixed) will be in the range of about 4000 rpm to about 8000 rpm. The inertia mass, i.e., the polar rotational inertia, will usually be in the range of about 15–25 lb-ft$^2$, while the weld upset (a known term described in the examples which follow) will usually be in the range of about 0.05 inch to about 0.5 inch. Again, those of skill in the art can adjust some of these parameters, such as the rotational speed, to conform to changes in the dimensions or compositions of the components being joined.

Still another suitable technique for joining the molybdenum structure to the structure formed from the more ductile alloy is explosive welding, which employs an explosive material or an intense electromagnetic field as the energy source for joining the structures. The general procedure for explosive welding is described in the Little and Lindberg texts mentioned above, as well as in other available references. Briefly, explosive welding occurs when the two structures are impacted together under an explosive force at high velocity, e.g., about 500 to about 1000 feet per second. The pressures produced by the velocity at the interface of the two structures is usually in the range of about 100,000 to about 1,000,000 psi. The collision of the parts appears to initiate a wave train along the part surfaces that plastically deforms them, stretching and rupturing the surface films to permit bonding. A high-strength weld is usually produced.

Other details regarding explosive welding can be easily uncovered in the literature. In general, the advantages regarding this technique include its simplicity; the large surface areas which can be bonded; and the ability to bond dissimilar, incompatible alloys. Moreover, explosion-welded bonds do not have heat-affected zones. Since the joint between the parts is created primarily by high compressive forces, no melting of the material is required. Therefore, no subsequent grain growth and embrittlement will occur in the joined structure. This is a very important advantage for the type of equipment which requires that such structures have very high endurance and reliability, e.g., the x-ray assemblies discussed below.

Another form of solid state bonding which can be used in some embodiments of the present invention is known as upset welding, and is described in the R. Lindberg text, for example. As one illustration, the components being welded can be placed in suitable electrode clamps. The bonding surfaces are brought into contact, and then a current is applied—usually at a current density of about 2000 to 5000 A/in$^2$. The high resistance of the joint causes heating of the material below its melt temperature) at the interface, while just enough pressure is applied to prevent arcing. As the metal becomes plastic, the force is usually great enough to make a large, symmetrical upset that expels oxidized metal from the joint area. Final pressures are usually applied after heating is completed. The pressure force will depend on the particular materials being joined, but is usually in the range of about 2500 psi to about 8000 psi. The upset region may have to be machined after the welding and before the joined articles are put into use. As in the case of the other bonding techniques described herein, there are various categories of this technique, such as upset butt welding and flash butt welding. Moreover, those skilled in the art can modify the various welding parameters to suit particular types, geometry's, and sizes of the bonding components.

A variety of molybdenum-based alloys may be used in the present invention, i.e., joined to another alloy having greater ductility. Some are described in U.S. Pat. No. 4,574,388 of J. Port et al, incorporated herein by reference. As used herein, a "molybdenum-based alloy" is defined as an alloy containing at least about 50% molybdenum, along with any other compatible metal or combination of metals. One illustrative type of molybdenum alloy comprises molybdenum and zirconium.

Some molybdenum alloys of considerable interest further include titanium. One typical alloy material of this type is referred to as TZM, and it comprises (on a weight basis) about 0.5% titanium and about 0.1% zirconium, with the balance being molybdenum. Those of ordinary skill in the art understand that materials falling under the general definition of "TZM" may include minor amounts of other metals or alloys, e.g., less than about 1% by weight of one or more alloying elements like carbon, hafnium, or vanadium.

The alloy which exhibits greater ductility than the molybdenum-based alloy (and which is to be joined thereto) can be selected from a variety of materials. When this invention is utilized in the field of x-ray assemblies, the alloy is sometimes tantalum-based, i.e., containing at least about 50% by weight tantalum. Tantalum alloys are known in the art and described, for example, in U.S. Pat. Nos. 5,498,186 (M. Benz et al) and 5,171,379 (P. Kumar et al), both incorporated herein by reference. Often, the tantalum-based alloy comprises tantalum and tungsten, e.g., about 85% by weight to about 99% by weight tantalum and about 1% by weight to about 15% by weight tungsten, based on the weight of the alloy, and preferably, about 90% by weight to about 98% by weight tantalum and about 2% by weight to about 10% by weight tungsten. In some preferred embodiments, the tantalum-based alloy further comprises less than about 1% (for each) of at least one additional metal or alloy, such as hafnium, rhenium, or yttrium.

Specific, non-limiting examples of suitable tantalum-based alloys are as follows: Ta-10W (Ta, 10W); T-111 (Ta, 8W, 2Hf); T-222 (Ta, 9.6W, 2.4Hf, 0.01C); ASTAR-811C (Ts, 8W, 1Re, 1Hf, 0.025C); GE473 (Ta, 7W, 3Re); Ta-2.5W (Ta, 2.5W); and Ta-130 (Ta with about 50 to 200 ppm Y).

Another alloy which exhibits greater ductility than the molybdenum-based alloy (and which can be joined thereto) is a niobium-based material, i.e., an alloy containing at least about 50% niobium, along with any other compatible metal or combination of metals. As one illustration, the niobium alloy may comprise niobium and molybdenum, and in some embodiments, may further comprise titanium. Specific examples of other suitable niobium alloys are as follows: CB-752 (Nb, 10W,2.5Zr);C129Y(Nb, 10W, 10Hf,0.1 Y); FS-85 (Nb, 28 Ta, 11W, 0.8 Zr); C103 (Nb, 10 Hf, 1 Ti, 0.7 Zr). C103 is sometimes the preferred alloy of this type, especially when the end use involves x-ray equipment. As in the case of tantalum, the niobium alloys sometimes contain less than about 1% (for each) of at least one additional metal or alloy, such as hafnium, rhenium, or yttrium.

Nickel-based alloys represent yet another type of material which exhibits greater ductility than the molybdenum-based alloy, and which could be joined thereto. For the present description, these alloys are considered to contain at least about 50% nickel, along with any other compatible metal or combination of metals. Specific examples of suitable nickel-based alloys are as follows: Hastelloy™ B2 (Ni, 28 Mo, 5 Fe, 2.5 Co); Hastelloy X (Ni, 22 Cr, 18.5 Fe, 9 Mo); Inconel™ 718 (Ni, 19 Cr, 12 Fe, 5 Nb, 3 Mo); Inconel™ 625 (Ni, 21.5 Cr, 9 Mo, 5 Fe, 3.7 Nb); and Waspaloy (Ni, 19.5 Cr, 13.5 Co, 4.3 Mo, 3 Ti, 2 Fe). Many more nickel alloys are known in the art and commercially available. Moreover, the nickel alloys can also contain less than about 1% (for each) of at least one additional metal or alloy, such as hafnium, rhenium, or yttrium.

In some embodiments, the molybdenum-based alloy is pre-heated before bonding, e.g., to a temperature between about room temperature and about 800° C., and preferably, in the range of about 400° C. to about 800° C. Some preferred embodiments set the range between about 400° C. and about 600° C. The pre-heating step helps to improve the ductility of the alloy, enhancing its flow- and deformation-characteristics during the actual bonding step. In effect, this step balances the deformation of dissimilar alloys.

As mentioned above, each structure being joined according to the present invention is often a component of an x-ray device, e.g., a part of the anode assembly of such a device. These devices are well-known in the art, but some general discussion herein would be of value. Exemplary patents which describe x-ray devices and related technology include those of Benz et al and Port et al, mentioned above, as well as 4,736,400 (Koller et al); 4,670,895 (Penato et al); and 4,367,556 (Hubner et al), all incorporated herein by reference. Numerous other references are a source of instructive information regarding x-ray tubes. One example is the *Encyclopedia Americana,* Vol. 29, 1994, Grolier, Inc., pp. 619 et seq.

FIG. 1 depicts a typical x-ray system 20, generally enclosed in a casing 52. The x-ray system includes an anode end 24, a cathode end 26, and a center section 28 positioned between the anode end and the cathode end. The center section contains the x-ray tube 30. The system further includes a cathode plate 54, a rotating target 56 (usually made from a molybdenum alloy like TZM), and a rotor 58, which is enclosed in a glass envelope 60. A window 64 for emitting the x-rays is formed in the casing 52, in a position relative to target 56, so that x-rays can exit the x-ray system. As described in the referenced U.S. Pat. No. 5,498,186, the system usually includes other features which don't require elaboration here, e.g., a radiator. The casing is usually filled with oil, to absorb the heat produced by the x-rays.

Figure 2:
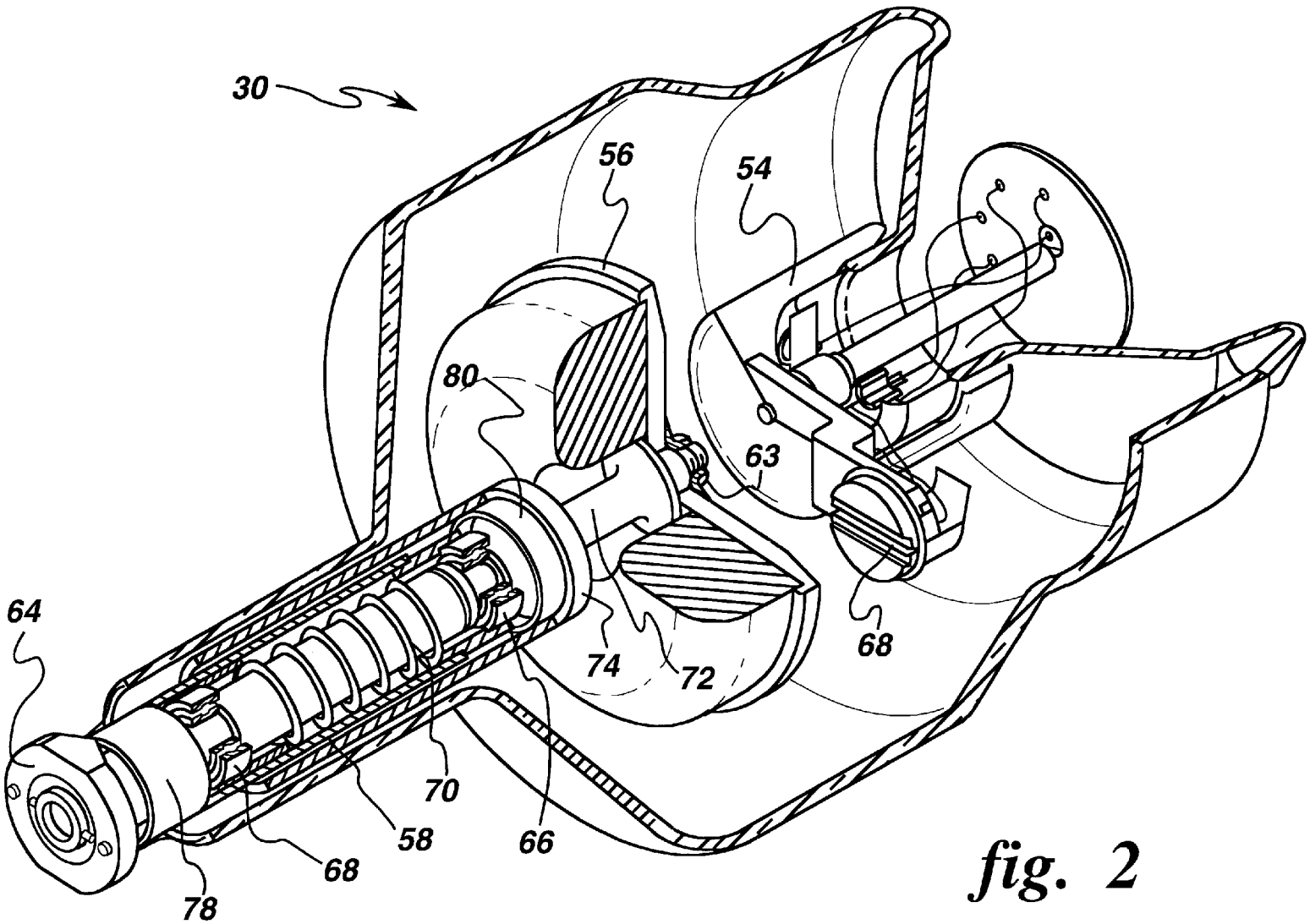
FIG. 2 is a partial perspective view of a representative x-ray tube, with parts removed, parts in section, and parts broken away.

With reference to FIG. 2, cathode 54 is positioned inside the glass envelope 60, within a vacuum. As is well-known, electrical energy generates the electron beam that is aimed from the cathode filament 68 to the top of the target 56. The target is usually connected to a rotating shaft 61 by conventional mechanisms. Here, for example, a Belleville nut 63 fastens one end of the shaft to the target, while another nut is used to hold end 64 of the shaft in place. Front bearing 66 and rear bearing 67 are operatively positioned on the shaft 61, and are also fastened conventionally.

Preload spring 70 is positioned about shaft 61 between the bearings 66 and 67. It maintains the load on the bearings during expansion and contraction of the anode assembly. A rotor stem (stud) 72 is used to space the end of the rotor most proximate the target 56 from the rotor hub 74. Bearings 66 and 67 are held in place by retainers 80 and 78. The rotor body assembly also includes a stem ring and a stem, all of which help to provide for the rotation of the rotor 58 with the target 56.

High temperatures can occur in various sections of the x-ray system during operation, as mentioned earlier and also described in co-pending U.S. application Ser. No. 08/731,445, filed on Oct. 15, 1996 of Melvin R. Jackson and Michael R. Eggleston, assigned to the assignee of the present invention and incorporated herein by reference. The high temperatures and related thermal shocks can result in a variety of problems, like loosening or damaging the rotary anode. This can in turn cause the entire anode-rotary assembly to become unbalanced.

Figure 3:
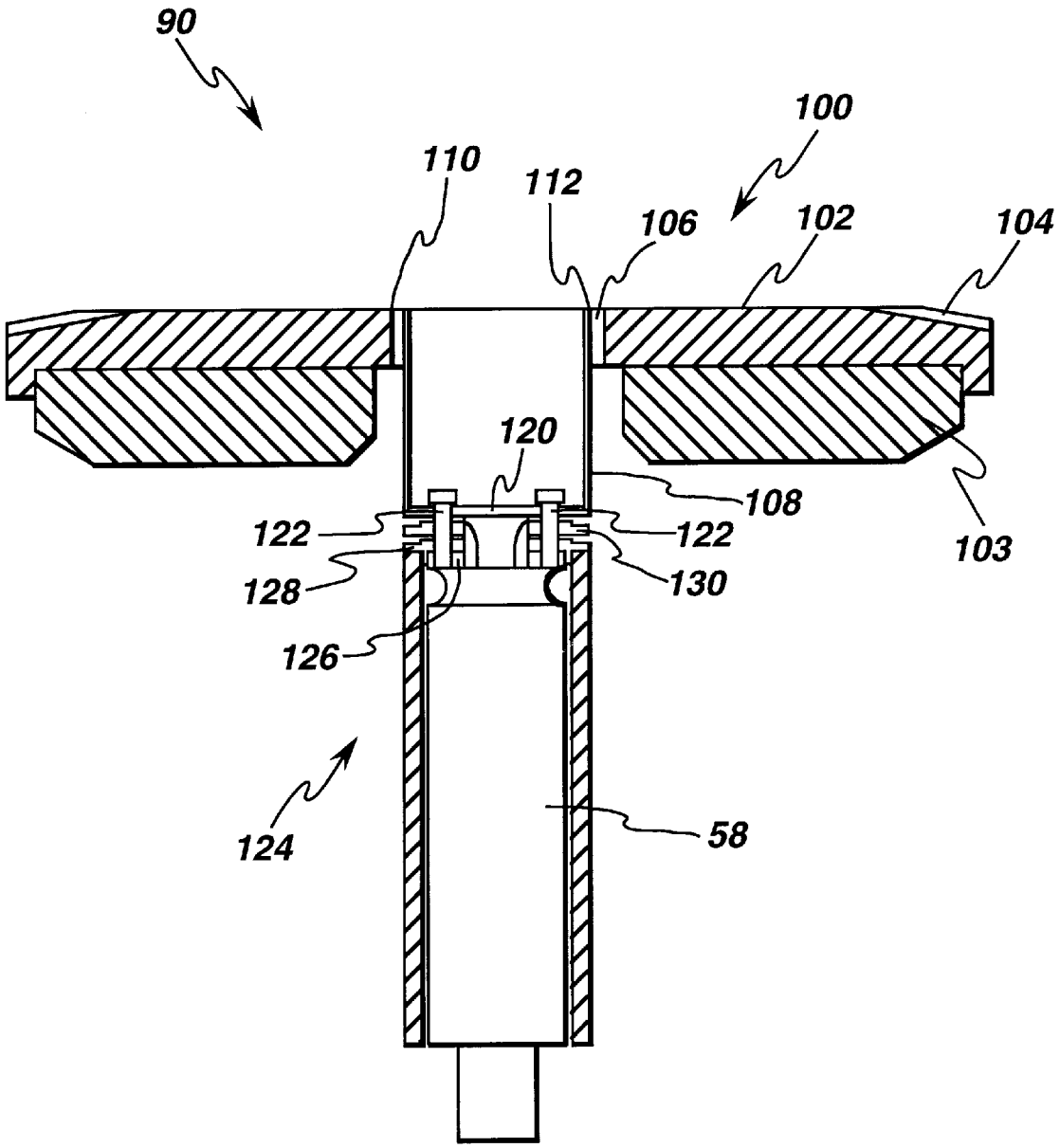
FIG. 3 is a sectional view of a target/stem assembly for an x-ray tube, including features associated with the present invention.

As mentioned earlier, some of the connections within the anode-rotor assembly are susceptible to damage when thermally stressed because they are formed from alloys of different ductility. FIG. 3 depicts a typical anode assembly and serves to illustrate such a situation. The assembly is generally designated as reference numeral 90, and includes a target/stem assembly 100 and a rotor body assembly 124. The target/stem assembly includes target 102, attached to a graphite back 103. Assembly 100 also includes a focal track 104 (connected to the target by standard metallurgical techniques) on which the x-rays are generated. These x-rays pass through the window 64, as previously shown in FIG. 1. Stem 108 is usually tubular in shape, and is often formed from niobium or a niobium-based alloy. Insert 106, which lines a central cavity within target 102, is usually formed from a tantalum-based alloy as described above, or from a niobium-based alloy, as described in the referenced, co-pending U.S. application Ser. No. 08/731,444. The attachment of an insert formed from the tantalum-or niobium-based alloy to a target formed from a molybdenum-based alloy is one factor important to the integrity of the assembly. However, the difference in ductility between the two structures can result in the problems discussed above.

These problems are substantially overcome by solid-state bonding the insert to the target, as discussed above. Thus, one embodiment of the present invention is an improved method for bonding a target to a tubular stem for use in a rotating x-ray tube, comprising the steps of:

(I) solid-state bonding the insert to the target;

(II) attaching the tubular stem to the combined target/insert to form a stem/target assembly; and (III) connecting the stem/target assembly formed in step (II) to a rotor body assembly.

Figure 4:
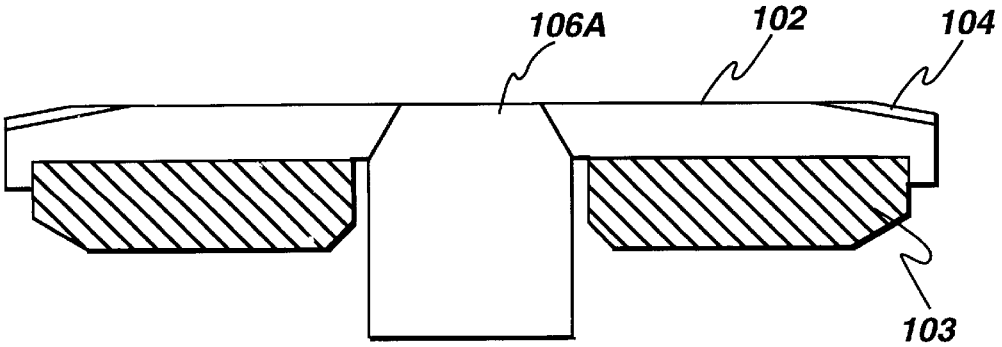
FIG. 4 is a sectional view of a target/stem assembly in which an insert is introduced in the form of a tapered cylinder.
Figure 5:
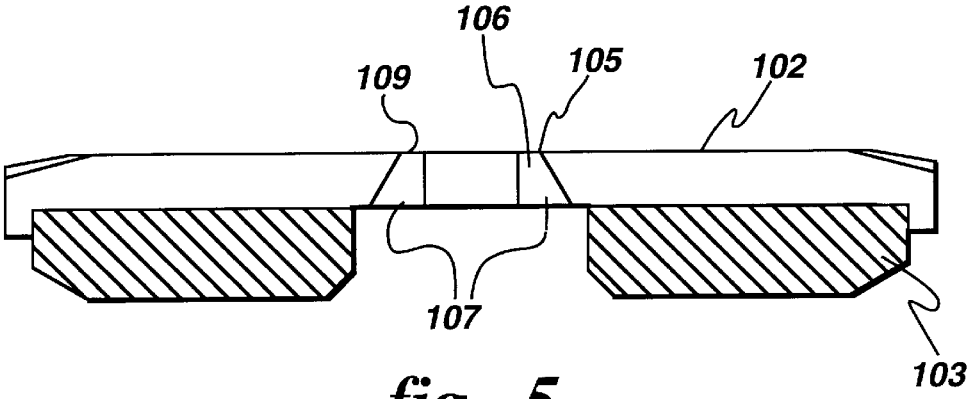
FIG. 5 is a sectional view similar to that of FIG. 4, after the insert has been machined to an annular shape for receiving a portion of the stem.
Figure 6:
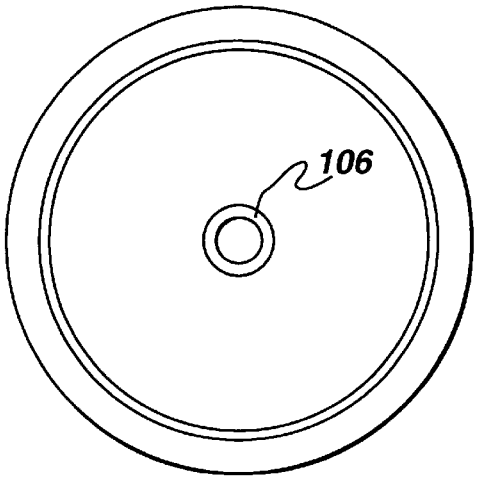
FIG. 6 is a top view of the assembly of FIG. 5, depicting the ductile insert attached to the x-ray target formed of a less ductile material.

FIG. 4 is a sectional view of a target/stem assembly being prepared according to one embodiment of the present invention, in which an insert 106A is initially in the form of a tapered cylinder, and is introduced into a central cavity of target 102. The joint between the insert and the target is formed by solid state-bonding, as discussed previously. After the joint is formed, the target can be machined so that the shaped, annular insert 106 is now present on the inner-diameter surface of the target, as depicted in FIG. 5. A top view of the assembly of FIG. 5 is shown in FIG. 6. As noted previously, solid-state bonding results in a very strong joint between a target formed from a molybdenum alloy and an insert formed from a more ductile material, such as a tantalum alloy. The joint is also very reproducible, i.e., in terms of multiple anode assemblies being produced on a production line. This consistency in weld quality can greatly increase productivity and decrease manufacturing cost.

The insert is initially tapered as in FIG. 4, since tapering facilitates insertion of the insert-cylinder into the target in some instances. However, those of skill in the welding arts understand that there are alternatives for joining the components. As an example, a face of the insert could be butt-welded to a face of the target. In that instance, there would be no need for the central cavity of target 102.

Moreover, the insert does not have to have a variable thickness, i.e., having a surface diameter 107 which is wider than surface diameter 105, as shown in FIG. 5. Instead, the insert could have a uniform diameter, as shown in FIG. 3. The shape of the insert will be determined in part by the shape of the cavity in the target, as well as the technique used for situating the insert in that cavity.

When explosion welding is chosen as the solid-state bonding technique, an axial cavity is usually first formed at the mating junction of the structures, i.e., at the mating surface of target 102 and insert 106 in FIGS. 4 and 5. Those skilled in explosion welding processes would understand that the cavity serves to direct the explosive bonding pressure in a direction radially outward, i.e., in a direction normal or substantially normal to the interface between the target and insert.

Other details regarding the fabrication of an x-ray anode assembly are generally known in the art and can be found in a variety of references, such as the above-referenced patents: U.S. Pat. Nos. 5,498,186 and 4,670,895. For example, a stress-relief anneal can be performed on the combined target/insert before the tubular stem is inserted therein. Moreover, after the combined target/insert is machined to provide final dimensions, it can then be labeled, inspected, and cleaned.

The connection between the insert and the tubular stem can be carried out by a variety of well-known techniques, such as diffusion-bonding, which is described, for example, in U.S. Pat. No. 4,736,400, incorporated herein by reference. In that procedure, the stem could be press-fitted into the insert so that sufficient diffusion-bonding pressure between the two structures is provided. Bonding is then accomplished according to an appropriate time/temperature schedule.

In one specific embodiment of this invention, a target is bonded to a tubular stem by a method which comprises these steps:

(a) pressing and sintering the target, which is formed from a molybdenum alloy;

(b) forging the target at a temperature of about 1400° C. to about 1700° C.;

(c) solid-state bonding a ductile insert (i.e., more ductile than the target material) to the target, as described previously;

(d) stress relief-annealing the combined target/insert at a temperature in the range of about 1500° C. to about 1900° C.;

(e) machining the combined target/insert;

(f) providing a tubular stem;

(g) providing a bottom plate;

(h) connecting the bottom plate to the tubular stem;

(i) inserting the tubular stem into the target/insert combination;

(j) final heat-treating the stem/target combination from about 1200° C. to about 1600° C. for a time period sufficient to diffusion-bond the target/insert to the tubular stem, wherein the coefficient of thermal expansion of the stem material is greater than the coefficient of thermal expansion of the insert material, which is in turn greater than the coefficient of thermal expansion of the target material; and (k) connecting the target/stem assembly to a rotor body assembly.

There are at least several variations on this process, and they all fall within the scope of this invention. For example, step (b) could be carried out after step (c), i.e., forging after the insert has been welded to the target. Other details regarding the alternative embodiments can be found in various references, such as those made of record herein.

The solid-state bonding step should result in a very strong joint between the target and the insert, assisting in preventing anode assembly imbalance during operation. This in turn helps to ensure greater reliability for the entire x-ray device. Moreover, these joining techniques have distinct advantages over those of the prior art, such as diffusion bonding—especially in the case of some of the end uses described herein. For example, the very short bonding times utilized herein result in greatly-decreased processing times for fabricating equipment made from such alloys, such as x-ray equipment. In contrast, diffusion bonding often requires well over 1 hour of bonding time.

Furthermore, the localized nature of bonding according to this invention helps to ensure the overall integrity of the equipment. In comparison, diffusion bonding often requires bringing an entire component up to bonding temperature, which can damage parts of the component which are not involved in the bonding itself Thus, it is apparent that use of the present invention is quite advantageous, from the viewpoint of both the preparation and the qualities of the final product.

EXAMPLES

EXAMPLE 1

This example is merely illustrative, and should not be construed to be any sort of limitation on the scope of the claimed invention.

Five test runs were carried out. Each involved the inertia-welding of 0.625 inch-diameter rods of TZM (0.5% titanium, 0.1% zirconium, balance being molybdenum) to two different tantalum alloys. Inertia welding parameters are provided in the table. The comments regarding weld quality are based on observations from individuals who have a high level of skill in the welding arts.

TABLE 1

Welding Results

| Run # | Alloy* | Fly Wheel Mass** | Pressure (psig)*** | Weld Upset | Bond Results (Qualitative) |
|---|---|---|---|---|---|
| 1 | Ta-10W | 3.286 | 250 | 0.032" | Poor; broke apart after welding |

TABLE 1-continued

| Run # | Alloy* | Fly Wheel Mass** | Pressure (psig)*** | Weld Upset | Bond Results (Qualitative) |
|---|---|---|---|---|---|
| | | Welding Results | | | |
| 2 | Ta-10W | 5.156 | 400 | 0.261" | Fair; large voids at the interface |
| 3 | SGS Ta | 5.156 | 400 | 0.635" | Good; excessive weld upset |
| 4 | SGS Ta | 3.286 | 250 | 0.291" | Good; insufficient TZM upset |
| 5 | SGS Ta | 3.286 | 250 | 0.280" | Good (TZM pre-heat at 400° C.) |

*Ta-10W: Tantalum with 10% by weight tungsten; SGS Ta: tantalum alloy micro-alloyed with yttrium for stabilized grain size; also known as TA-130; available from H. C. Starck, Inc.
**Flywheel polar inertia (i.e., rotational inertia), units are lbs-ft$^2$; initial wheel spinning speed: 6050 rpm.
***Hydraulic pressure.

The sample-weld of Run #1 was relatively poor in quality. This appeared to be due to insufficient adjustment of various weld parameters, like hydraulic pressure and fly wheel mass. "Weld upset" is an art-recognized measurement of the displacement of material when two metal parts are brought together in a solid-state welding process. The material is pushed outside the edges of the area of part contact. Too small an "upset" value is usually undesirable, as is too great an upset value. For Run #1, the value was too small.

The sample-weld of Run #2 was considerably higher in quality than that of Run #1 , due in large part to adjustment of fly wheel mass and hydraulic pressure. Sectioning of the sample revealed small voids at the interface. The voids were not especially desirable, but it is expected that further adjustment of various parameters would substantially eliminate them.

The sample-weld of Run #3, using the micro-alloyed tantalum alloy, was of good quality, although the weld upset value was somewhat excessive. Pressure and fly wheel mass values were reduced for Run #4, and another weld of good quality was produced, although the upset value appeared to be somewhat lower than desired.

The sample-weld of Run #5 was also of good quality. The TZM rod had been pre-heated to 400° C. to improve its ductility, by obtaining better flow and deformation.

EXAMPLE 2

In this example, inertia welding was used to form welds between a tubular TZM component and a tubular component formed from one of the nickel-based alloys described above, Hastelloy B2. Each tube had an outer diameter of 0.625 inch and an inner diameter of 0.422 inch. The tubes were butt-end welded, and ten test runs were carried out. The various welding parameters are provided in Table 2. In each instance the actual welding time was less than 10 seconds. As in example 1, the comments regarding bond quality are based on visual observations from an individual who has a high level of skill and experience in the welding arts. No physical tests were carried out on the welds.

TABLE 2

| Run # | Alloy* | RPM** | Inertia Mass*** (lb-ft$^2$) | Ram Pressure (psi)**** | Weld Stress (psi) | Axial Upset (inches) | Energy Density (ft-lb/in$^2$) | Bond Results (Quatitative)[a] |
|---|---|---|---|---|---|---|---|---|
| | | | | Welding Results (TZM-Ni) | | | | |
| 6 | Ni—Mo | 4267 | 3.286 | 472 | 13840 | 0.037 | $61 \times 10^3$ | No Weld |
| 7 | Ni—Mo | 4267 | 3.286 | 472 | 13480 | 0.020 | $61 \times 10^3$ | Weld |
| 8 | Ni—Mo | 4917 | 3.286 | 675 | 35186 | 0.049 | $81 \times 10^3$ | Weld |
| 9 | Ni—Mo | 5212 | 3.286 | 1350 | 70372 | 0.141 | $91 \times 10^3$ | Weld |
| 10 | Ni—Mo | 5490 | 3.286 | 1350 | 70372 | 0.323 | $101 \times 10^3$ | Weld |
| 11 | Ni—Mo | 5490 | 3.286 | 1350 | 70372 | 0.161 | $101 \times 10^3$ | Weld |
| 12 | Ni—Mo | 5212 | 3.286 | 1350 | 70372 | 0.207 | $91 \times 10^3$ | Weld |
| 13 | Ni—Mo | 7648 | 1.526 | 1350 | 70372 | 0.161 | $91 \times 10^3$ | Weld |
| 14 | Ni—Mo | 7648 | 1.526 | 1350 | 70372 | 0.288 | $91 \times 10^3$ | Weld |
| 15 | Ni—Mo | 11629 | 0.660 | 1350 | 70372 | 0.280 | $91 \times 10^3$ | No Weld |

*Hastelloy ™ B2, with composition as follows; Ni (balance), 28 Mo, 5 Fe, 2.5 Co, plus trace components
**Rotations per minute
***Flywheel polar inertia (i.e., rotational inertia).
****Hydraulic pressure.
(a) Based on visual examination of bonds.

Run #6 did not result in a weld because of a "stuck weld" condition. In all probability, the proper temperature at the interface was not achieved. Run #15 also was a stuck weld. The upset may have been too large, and the rotational speed was also very high, possibly resulting in too much of the plastic-state metal being pushed away from the weld site.

Successful welds were made in Run #'s 7 through 14.

It is clear that, although various parameters have to be adjusted to optimize weld quality for a given pair of materials being attached, solid-state techniques like inertia welding are very well-suited for providing a strong, reliable joint between molybdenum-based materials and more ductile materials.

Having described embodiments of the present invention, alternative embodiments may become apparent to those skilled in the art without departing from the spirit of this invention. Accordingly, it is understood that the scope of this invention is to be limited only by the appended claims.

All of the patents, articles, and texts mentioned above are incorporated herein by reference. The various quantities and percentages presented in the patent application are expressed in terms of weight values, unless otherwise indicated.

What is claimed:

1. An anode assembly for an x-ray tube, the assembly comprising:

(a) an x-ray target formed of a molybdenum-based alloy, and having a central cavity formed therein;

(b) an insert within the central cavity, shaped to receive a portion of a tubular stem, and formed from an alloy material which is more ductile than the target alloy;

(c) a tubular stem connected to the target forming a target/stem assembly; and (d) a rotor body assembly adapted for connection to the target/stem assembly and rotation therewith, wherein the target is solid-state bonded to the insert.

2. The anode assembly of claim 1, wherein the molybdenum-based alloy comprises titanium, zirconium, and molybdenum.

3. The anode assembly of claim 1, wherein the more ductile alloy is tantalum-based.

4. The anode assembly of claim 1, wherein the target has been inertia-welded to the insert.

5. The anode assembly of claim 1, wherein the bond between the target and the insert exhibits bond characteristics attributable to a bonding period of less than about 1 minute.

6. A method for forming a joint between a molybdenum based alloy structure and a structure formed from a more ductile alloy, the molybdenum based alloy structure comprises a rotatable x-ray target, while the structure formed from the more ductile alloy comprises an x-ray target insert, wherein said method comprises solid-state bonding of the two structures over a bonding period of less than about 1 minute, the solid-state bonding comprising friction welding by inertia-welding technique, the inertia welding comprises:

a) placing the structures to be joined together in an inertia-welding apparatus, whereby the respective, joining surface areas of the structures are spaced from each other and positioned to contact each other at a bonding interface;

b) rotating one of the structures at a predetermined rotational speed and a corresponding mechanical energy value while the other structure remains fixed in a non-rotating position, wherein the predetermined rotational speed is high enough to provide sufficient energy for bonding when the rotating structure comes into contact with the fixed structure; and c) bringing the two structures into contact with each other, whereby the heat generated as the mechanical energy of the rotating structure is dissipated is sufficient to plastically deform the metal at the bonding interface, causing a joint to be formed between the two structures.

7. The method of claim 1, wherein the molybdenum-based alloy structure is a rotatable x-ray target, while the structure formed from the more ductile alloy is an x-ray target insert.

8. The method of claim 1, wherein the molybdenum-based alloy comprises titanium, zirconium, and molybdenum.

9. The method of claim 1, wherein the molybdenum-based alloy comprises titanium, zirconium, and molybdenum.

10. The method of claim 1, wherein the x-ray target is bonded to the target insert at a bonding angle which is about 25 to about 45 degrees with respect to the rotational axis of the target, under a contract stress perpendicular to the weld joint in the range of about 4500 psi to about 10,000 psi, while the speed of the rotating structure is in the range of about 4000 rpm to about 8000 rpm, and the inertia mass is in the range of about 15 lb-ft$^2$ to about 25 lb-ft$^2$.

11. The method of claim 1, wherein the x-ray target insert comprises a tantalum-based alloy.

12. The method of claim 1, wherein the more ductile alloy is tantalum-based.

13. The method of claim 12, wherein the tantalum-based alloy comprises tantalum and tungsten.

14. The method of claim 13, wherein the tantalum-based alloy comprises about 85% by weight to about 99% by weight tantalum and about 15% by weight to about 1% by weight tungsten.

15. The method of claim 12, wherein the tantalum-based alloy is selected from the group consisting of Ta-10W (Ta, 10W); T-111 (Ta, 8W, 2Hf); T-222 (Ta, 9.6W, 2.4Hf, 0.01C); ASTAR-811C(Ta, 8W, 1Re, 1Hf, 0.025C); GE473 (Ta, 7W, 3Re); Ta-2.5W (Ta, 2.5W); and Ta-130 (Ta with about 50 to 200 ppm Y).

16. The method of claim 1, wherein the more ductile alloy is niobium-based or nickel-based.

17. The method of claim 16, wherein the niobium-based alloy comprises niobium and molybdenum.

18. The method of claim 17, wherein the niobium-based alloy further comprises titanium.

19. The method of claim 1, wherein the molybdenum-based alloy is pre-heated before solid-state bonding.

20. The method of claim 19, wherein the pre-heating is at a temperature of up to about 800° C.

21. The method of claim 20, wherein the pre-heating is at a temperature in the range of about 400° C. to about 800° C.

22. A method for bonding a target to a tubular stem for use in a rotating x-ray tube, wherein an insert is attached to the target and positioned for additional attachment to the tubular stem, said target comprising a molybdenum-based alloy, and said insert comprising an alloy more ductile than the target alloy, said method comprising:

(I) solid-state bonding the insert to the target to form a combined target/insert, wherein the bonding period is less than about 1 minute;

(II) attaching the tubular stem to the combined target/insert to form a stem/target assembly; and (III) connecting the stem/target assembly formed in step (II) to a rotor body assembly.

23. The method of claim 22, herein the solid state bonding comprises inertia-welding.

24. The method of claim 22, wherein the bonding period is less than about 30 seconds.

25. The method of claim 22, wherein the molybdenum based alloy comprises titanium, zirconium, and molybdenum.

26. The method of claim 22, wherein the insert alloy is tantalum-based.

27. The method of claim 22, wherein the molybdenum-based alloy is pre-heated before solid-state bonding.

28. The method of claim 27, wherein the pre-heating is at a temperature of up to about 800° C.

* * * * *